US010910211B2

(12) United States Patent
Chang

(10) Patent No.: US 10,910,211 B2
(45) **Date of Patent: *Feb. 2, 2021**

(54) ELECTRICAL POTENTIAL ENERGY TO ELECTRICAL KINETIC ENERGY CONVERTER, OZONE GENERATOR, AND LIGHT EMITTER

(71) Applicant: Seongsik Chang, Santa Clara, CA (US)

(72) Inventor: Seongsik Chang, Santa Clara, CA (US)

(73) Assignee: Seongsik Chang, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/430,004

(22) Filed: Jun. 3, 2019

(65) Prior Publication Data

US 2019/0378707 A1 Dec. 12, 2019

Related U.S. Application Data

(60) Provisional application No. 62/718,237, filed on Aug. 13, 2018, provisional application No. 62/688,292, filed on Jun. 21, 2018, provisional application No. 62/682,715, filed on Jun. 8, 2018.

(51) Int. Cl.

| | |
|---|---|
| ***H01J 61/16*** | (2006.01) |
| ***H01J 1/144*** | (2006.01) |
| ***H01J 1/20*** | (2006.01) |
| ***H01J 61/20*** | (2006.01) |

(52) U.S. Cl.

CPC ..... *H01J 61/16* (2013.01); *H01J 1/144* (2013.01); *H01J 1/20* (2013.01); *H01J 61/20* (2013.01); *H01J 2201/3423* (2013.01)

(58) Field of Classification Search

None

See application file for complete search history.

(56) References Cited

U.S. PATENT DOCUMENTS

| | | | | |
|---|---|---|---|---|
| 4,666,679 | A * | 5/1987 | Masuda | C01B 13/11 422/186.07 |
| 10,262,836 | B2 * | 4/2019 | Chang | C02F 1/78 |
| 2002/0134932 | A1 * | 9/2002 | Guevremont | B01D 59/48 250/281 |
| 2019/0237301 | A1 * | 8/2019 | Chang | C02F 1/78 |

* cited by examiner

*Primary Examiner* — Ashok Patel

(74) *Attorney, Agent, or Firm* — Womble Bond Dickinson (US) LLP

(57) ABSTRACT

Embodiments of the present invention describe electrical potential energy to electrical kinetic energy converters, ozone generators, and light emitters. A system for energy conversion from electrical potential energy to electrical kinetic energy may include a discharge device and a power supply. The power supply can be coupled with the discharge device, and supplies energy to the discharge device to form an initial electric field. The discharge device may further include at least two electrodes that are either mesh electrodes or wire-array electrodes. Furthermore, a space between the at least two electrodes is filled with a gas medium and an electric field is created by the power supply in a normal direction relative to planes formed by the elements of electrodes.

17 Claims, 8 Drawing Sheets

ELECTRICAL POTENTIAL ENERGY TO ELECTRICAL KINETIC ENERGY CONVERTER, OZONE GENERATOR, AND LIGHT EMITTER

RELATED APPLICATIONS

This application claims priority to and the benefit of U.S. Provisional Patent Application No. 62/682,715, filed on Jun. 8, 2018, U.S. Provisional Patent Application No. 62/688,292, filed on Jun. 21, 2018, and U.S. Provisional Patent Application No. 62/718,237, filed on Aug. 13, 2018. The disclosures of the above applications are incorporated by reference herein in their entirety.

FIELD

Embodiments of the present invention relate generally to the field of energy, light, and ozone generation.

BACKGROUND

Currently, more than 80% of the energy consumed in the world is generated by burning fossil fuels. Fossil fuel burning emits $CO_2$ into the atmosphere that causes global warming. Global warming can devastate the environment that we live in. Alternative energy sources that do not emit $CO_2$ are definitely needed. However, these alternative energy sources have their own limits. The cost of solar energy has come down as competitive as fossil fuels, but solar energy cannot generate energy when or where there is not enough sunshine. The cost of wind energy is also as low as fossil fuels, but wind energy cannot generate energy when or where there is not enough wind. Furthermore, energy storage technology is not mature enough to store energy generated from these sources for future use. Hydroelectricity is clean energy, but it is possible only where a waterfall structure can be built. Nuclear energy faces a big challenge of dangerous radioactivity when nuclear generator fails. Therefore, new renewable energy sources that do not depend upon weather and has no dangerous radioactivity would be more preferred.

Furthermore, water shortage has been a serious problem in some regions. Shortage of water is linked to loss of human lives to unhealthy situations by contaminated water consumption that is caused by reuse of contaminated water. If water can be efficiently recycled back to pure and healthy water, a limited supply of water can be tolerable. Ozone is an effective pathogen killer and used for water treatment in certain region. But, due to its high cost of ozone generation, chlorine is used more widely for killing pathogens inside the water. Low cost production of ozone will enable wide adoption of ozone as a water treatment source instead of chlorine.

Additionally, lighting system has advanced dramatically by perfecting LED manufacturing technology. At this point, LED is cost effective enough to replace incandescence light bulbs. Advantages of LED technology is that it LEDs have low energy consumption (at least 10 times when compared to traditional light bulbs) as well as a longer lifespan. However, LED uses complicated material deposition processes that use dangerous chemicals. Furthermore, luminescent density of LED light is inherently concentrated, and when seen by the naked eye, it can be harmful. If a light source could be manufactured without complicated chemical processes and/or provide the possibility of broad-area illumination, it will be preferred.

DETAILED DESCRIPTION

Figure 1A:
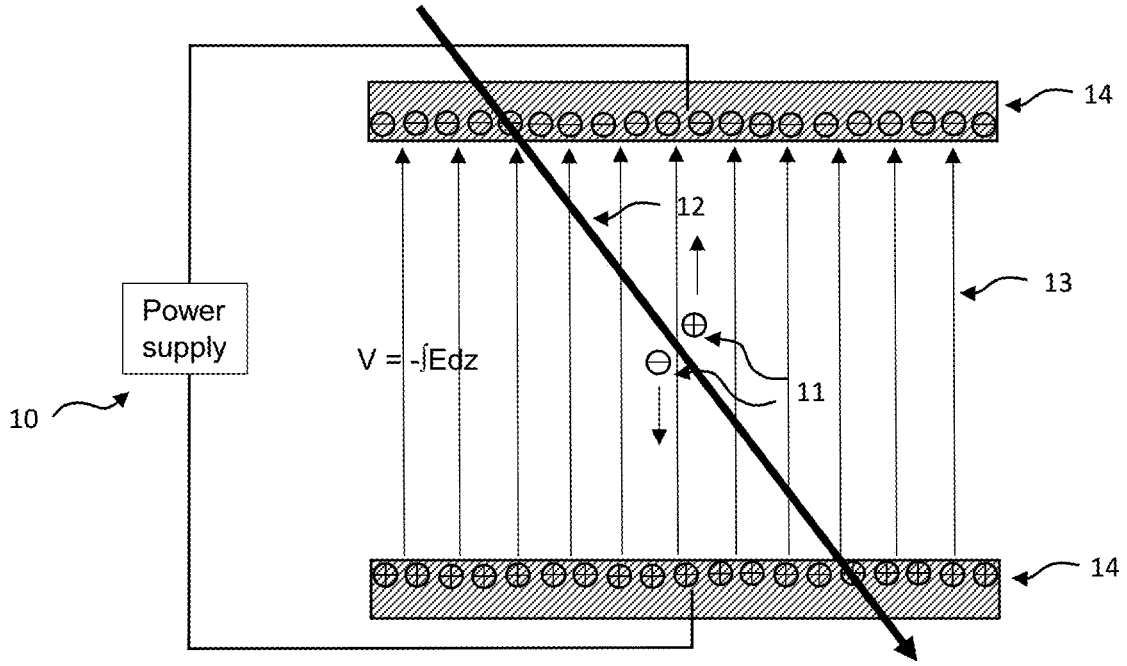
FIG. 1A illustrates an embodiment of two parallel plate electrodes with an electric field where charges are created through ionization by cosmic rays.
Figure 1B:
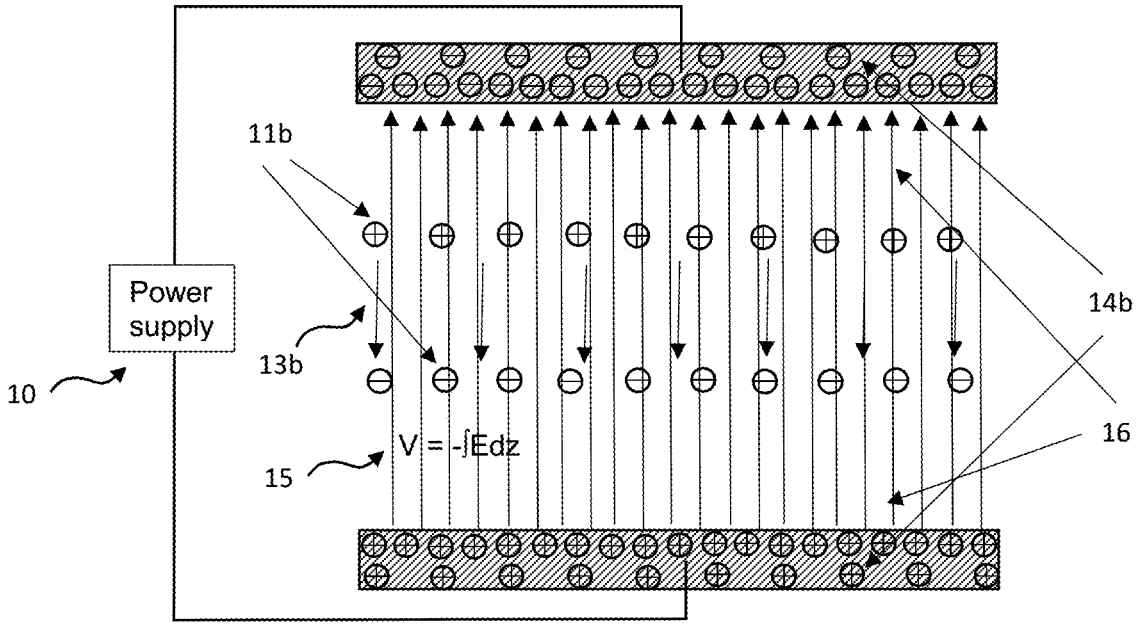
FIG. 1B illustrates an embodiment of two parallel plate electrodes within which many charges created and negate an initial electric field, which causes a power supply to provide more charges to satisfy a fixed voltage boundary condition.

In the following description, numerous details are set forth. It will be apparent, however, to one of ordinary skill in the art having the benefit of this disclosure, that the embodiments described herein may be practiced without these specific details. In some instances, well-known structures and devices are shown in block diagram form, rather than in detail, in order to avoid obscuring the embodiments described herein.

U.S. Pat. No. 10,262,836, issued on Apr. 16, 2019, describes methods and devices of making an electric generator by extracting charges from a plasma discharge device either by wind energy or by novel electrode geometry. It also describes an ozone generator and fluorescent light emitter using a similar structure. The free energy in these devices comes from cosmic rays from universe that initiate ionization and electric potential energy of charges that we intentionally constructed within the plasma discharge device. The potential energy is subsequently converted into many charges through impact ionization processes. If the charges are not removed from the device, the process stops because generated charges themselves negate initial electric field so that net electric field becomes less than Paschen threshold. If charges are extracted, the process will continue. Charge extraction can be done by wind or novel electrode geometry where charges can naturally escape. As long as no charges are used from the external power supply, other than initial charges that is needed to set up electric field, no more energy is consumed from the power supply. The subject matter described herein may be used in conjunction with or in addition to the subject matter of U.S. Pat. No. 10,262,836, which is hereby incorporated by reference in its entirety.

The generation process of flow of charges, i.e., electric current, in the subject matter of U.S. patent application Ser. No. 15/962,850 is actually an electrical version of a hydroelectric generator. In the hydroelectric generator, gravitational potential energy of water is converted into kinetic energy of water, and then into electric energy (kinetic energy of electrons) via turbine(s). Potential energy of water is given by atmospheric activities of the earth through solar energy. The subject matter of U.S. patent application Ser. No. 15/962,850 proposes to do the same with electric charges and electric field. An electric field is intentionally built with two electrodes. Cosmic rays triggers ionization of molecules within the electric field, which is equivalent to "placing charges" in an "electric potential", which have energy qV. If electric field is high enough, charge multiplication occurs through impact ionization, converting "electric potential energy" into multiple "kinetic energy" of charges. Charges that are extracted through novel electrode geometry can be used as a current source. This scenario is quite similar to a solar panel where "charges" are created by photons of sunlight that are placed in an electric potential built by a semiconductor heterostructure. Charges gain kinetic energy as they move within the heterostructure electric potential and are extracted through electrical leads.

Embodiments of methods and devices described therein includes energy efficient ozone generators which convert oxygen into ozone through plasma processes and energy efficient light emitters where a gas medium and enclosure is optimized for light emission that is inherent in the discharge processes.

Embodiments of the present invention, as described in a greater detail below, are the methods and devices of the electrical version of hydroelectric generators, ozone generators, and light emitters, with increased charge multiplication and extraction. The increased charge multiplication is possible, specifically when operated in streamer discharge regime. The increased charge extraction efficiency is possible in embodiments that include two parallel mesh electrodes and two parallel wire array electrodes, as described herein.

Enhanced Charge Multiplication With Positive Feedback

The amount of energy harvesting from cosmic rays in the subject matter of U.S. patent application Ser. No. 15/962,850 can be estimated as flows. If only potential energy of initial charges is counted, the estimated cosmic ray energy harvesting rate is (potential energy qV)·(cosmic ray flux)= 1000 eV·$10^4$ $m^{-2}sec^{-1}$~1.6 pW/$m^2$, where a reasonable 10 V/um of electric field over a 100 um gap is used. In this case, initial one charge with potential energy of 1000 eV multiplied into 67 since nitrogen molecule has ionization of 15 eV. This energy harvesting rate is quite small compared to a solar panel where energy harvesting density of ~1 kW/$m^2$ is achieved on average.

However, at one atmospheric pressure, it is routinely observed that the number of charges grows to as much as $10^{10}$, instead of 67, from one initial ionization event. The category of such atmospheric discharge is called a streamer discharge regime. FIGS. 1A, 1B, 1C, and 1D illustrate embodiments of increased charge multiplication by operating a discharge device in the streamer discharge regime. The increased charge multiplication is possible by a positive feedback processes between electric field enhanced Paschen breakdown and charges placed within the electrodes in a discharge system. Once pairs of charges 11 are created by cosmic rays 12, they are accelerated toward respective electrodes by initial electric field 13 supplied by the power supply 10, and then multiply. The electric field 13*b* created by the newly created charges 11*b* through charge multiplication process negates the initial electric field 13. Since a voltage is defined as an integration of electric field along a distance 15, the voltage between two electrodes will be lower than initial value. Since this violates a fixed boundary conditions at the electrodes, a power supply 10 provides more charges 14*b* to the electrodes to meet the fixed voltage boundary condition. As a result, the number of charges at the electrodes 14*b* is higher than the initial number of charges 14 before plasma charges are formed. Therefore, the electric field near the electrode 16, a region outside the plasma charge pairs 11*b*, is higher than initial electric field. Molecules in the region of the enhanced electric field induce more impact ionization and creation of charges, which in turn negate the electric field further more. This will induce the power supply to provide more charges to the electrode and increase electric field again. This process is a positive feedback process. This is how the number of plasma charges created by the feedback process, for example in the streamer, is much higher than what is expected from the potential energy of initial charges by an initial external field 13. The increase in the charge multiplication factor from 67 to $10^{10}$ is not free, but provided by the power supply 10. However, this will be only initial energy input of this device. More free energy will be created, not provided by the power supply 10 in the subsequent processes of charge extraction.

Figure 1C:
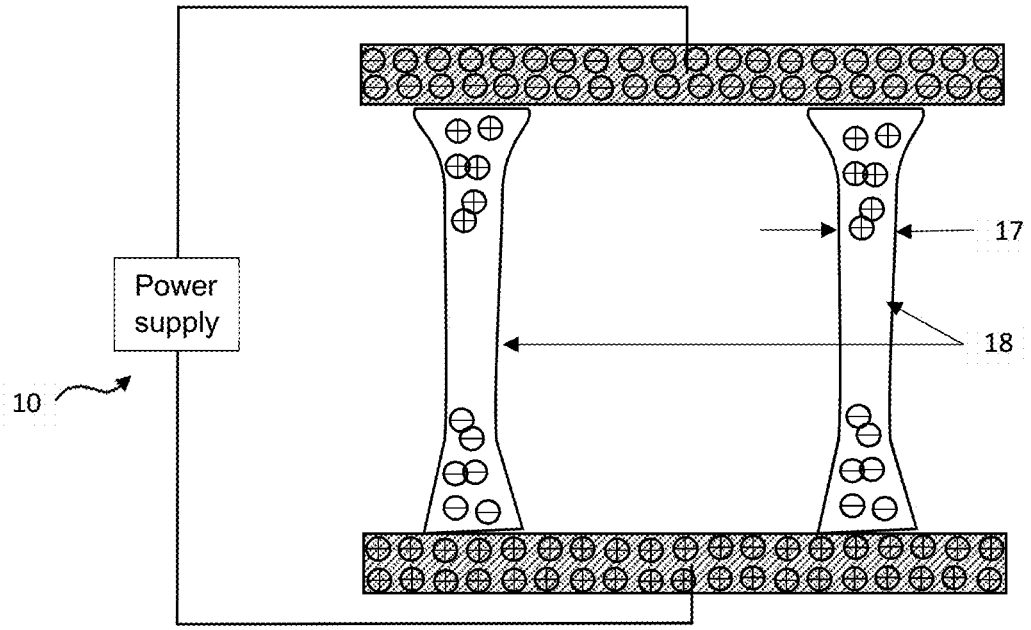
FIG. 1C illustrates streamers and a filamentary discharge, within an embodiment of a two parallel plate discharge system.
Figure 1D:
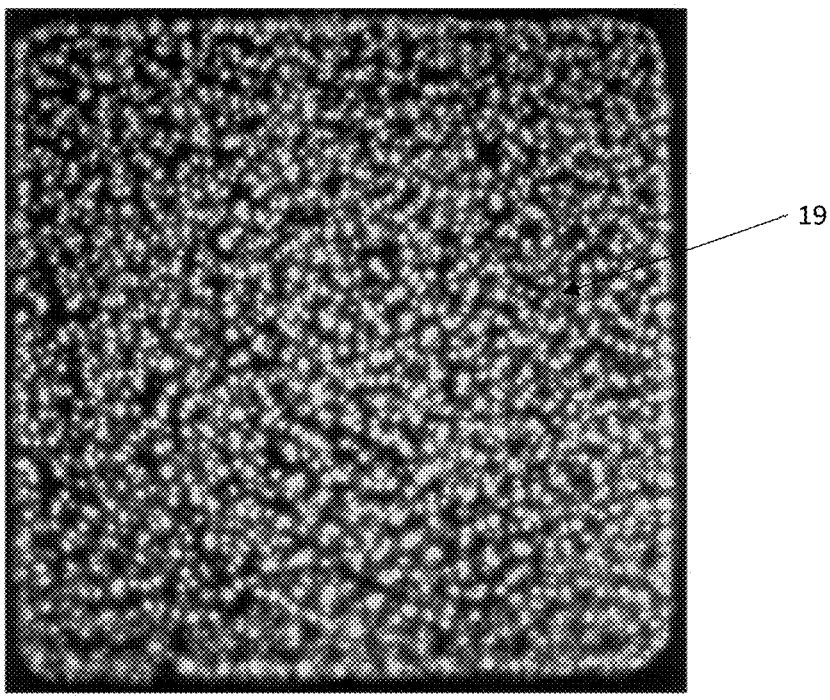
FIG. 1D illustrates an embodiment of a top view of filamentary discharges, streamers.

The amount of streamer formation per second can be estimated as follows. The shape of streamer is filamentary with about 100 um in diameter 17 as shown in FIG. 1C. Individual filament of charges is referred to as a streamer 18. Streamers within a dielectric barrier discharge configuration last usually about 100 nsec in a form of a pulse, which is equivalent to a time it takes to form such a streamer. However, without a dielectric barrier, this will turn into a continuous generation. Streamers can cover almost 50% of a given area, and therefore, area density of streamers is $10^8$ per $m^2$ 19. The total number of charges that can be produced within a 100 um gap of air is (the number of charges within a streamer ($10^{10}$))×(streamer density $10^8$ per $m^2$ per 100 nanosecond), therefore, $10^{25}/m^2$/sec. If nitrogen molecules are used, in embodiments, whose ionization energy is 15 eV, $1.5\times10^{26}$ eV/$m^2$/sec=$10^7$ W/$m^2$ of energy can be generated if these charges are extracted without any additional charges supplied from the power supply.

With metal electrodes, streamers can develop into arcing in the atmospheric pressure. By using semiconducting electrodes, in embodiments, this positive feedback process can be controlled so that no arcing occurs that destroys the system due to high temperature. Also, in embodiments, by using a current monitor that can feedback into the power supply, arcing can be prevented.

The methods and devices described in these embodiments can also be realized in a non-atmospheric pressure environment, such as enclosed space with less or more pressure than one atmospheric pressure. The less the pressure, the less the impact ionization gain. The methods and devices described in these embodiments also can be realized with molecules other than air molecules, such as helium, argon, Neon, or other molecules with desired cross sections of impact ionization and Paschen threshold.

Two Parallel Mesh Electrodes

Figure 2:
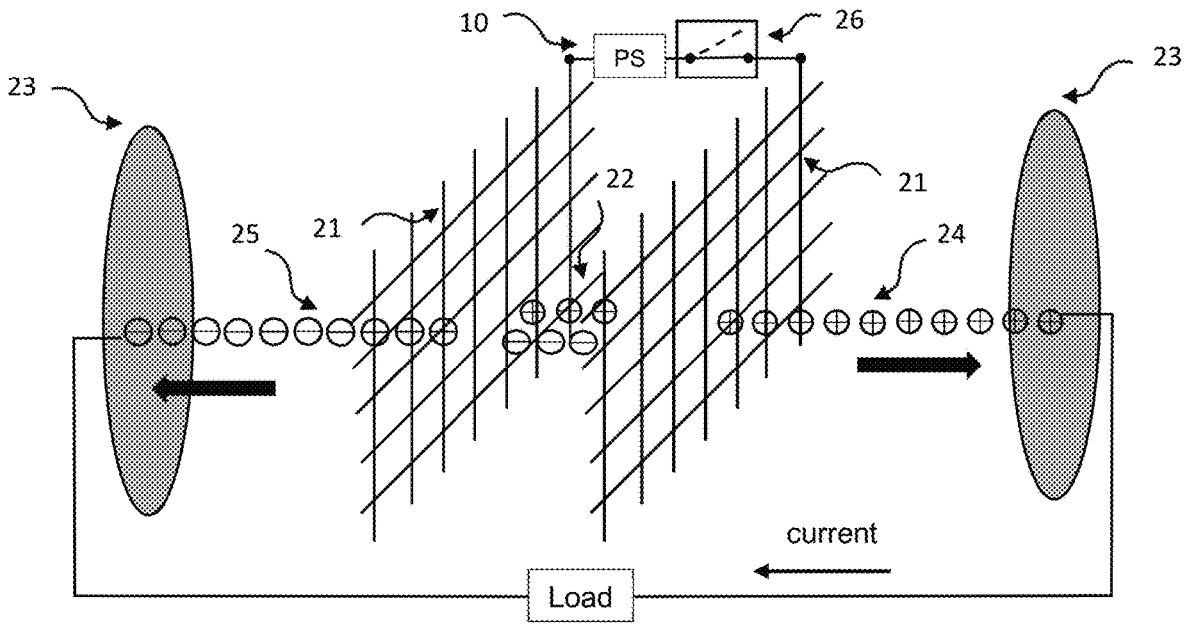
FIG. 2 illustrates an embodiment of a power generator with charge extraction from a mesh electrode discharge system.

The embodiment described in FIG. 2 is a power generator and current source via charge extraction from a plasma system. The embodiment comprises two parallel mesh electrodes 21 made of metal or semiconductor. Plasma 22 is generated between two mesh electrodes. Charges within the plasma region 22 get accelerated toward the mesh electrodes 21 and can escape through the mesh structures. Charge collectors 23, such as planar metal plates or curved metal plates, are placed outside the mesh electrodes 21 and placed so that the same number of positive ions 24 and electrons 25 are captured. This balance between two polarities of charges should be met so that zero charges are supplied from the power supply 10. Charges that do not escape, but instead hit the mesh electrodes 21 will draw current from the power supply 10, and therefore, will be counted as a loss. However, net energy will be generated if the energy associated with extracted charges 23, 24 is higher than the energy associated with the current drawn by the power supply 10. In another embodiment, a switch 26 is inserted between power supply and the discharge device. After plasma 22 is formed in the discharge device, the switch 26 can be turned off to make sure no more energy is supplied to the discharge device by the power supply 10. If the plasma 22 is getting weaker the switch 26 is turned on again to supplement lost charges at the electrodes 21. The switch 26 can be operated automatically by monitoring output currents 24, 25, such as by using an ammeter or voltage difference across resistor in series to monitor the output currents. In this embodiment, the materials for the mesh electrodes 21 are chosen to control charge multiplication processes, such as a metal or semiconductor material with various conductivity to control a positive feedback process between the electric-field enhanced Paschen breakdown and charges placed in the electrode. The choice of electrode material conductivity will also depend upon the pressure of the gas medium, which controls the gain of impact ionization.

Two Parallel Electrodes of Arrayed Wires

Figure 3:
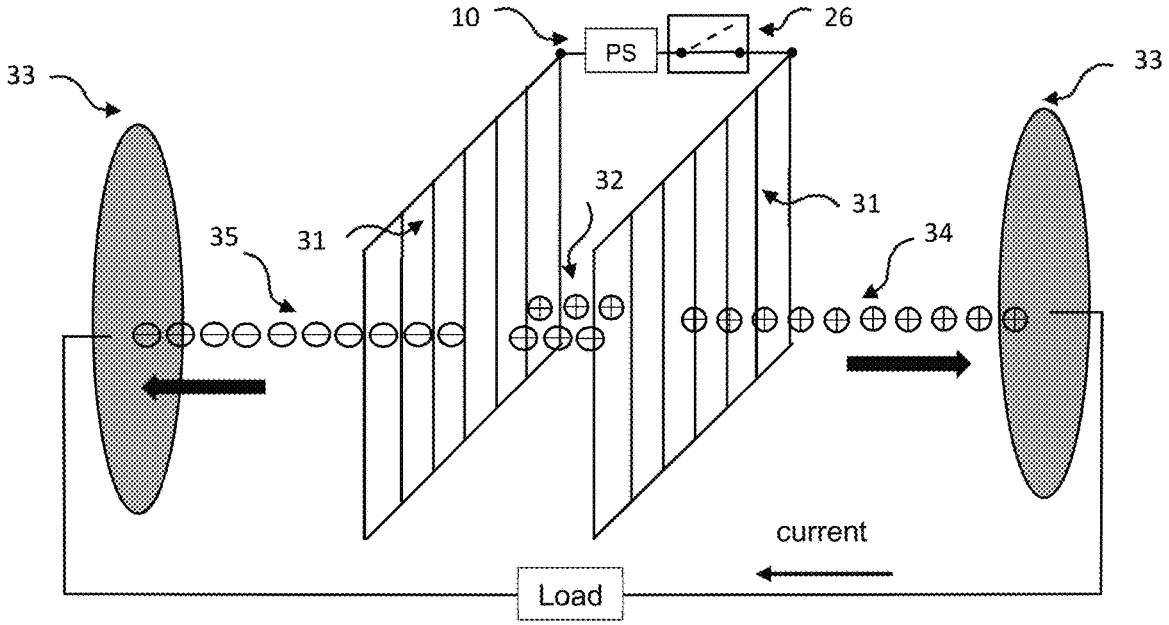
FIG. 3 illustrates an embodiment of a power generator with charge extraction from an arrayed wire electrode discharge system.

Another embodiment described in FIG. 3 is a power generator and current source via charge extraction from a plasma system. The embodiment comprises two electrodes made of parallel arrays of wires 31 made of metal or semiconductor. Plasma 32 is generated between two arrayed wire electrodes 31, accelerated toward the electrodes 31, and can escape through the spaces between the wires. Charge collectors 33, similar to the charge collectors discussed above, are placed outside the wire electrodes and placed so that the same number of positive ions 34 and electrons 35 are captured. This balance between two polarities of charges should be met so that zero charges are supplied from the power supply 10. Charges that do not escape, but instead hit the wire electrodes 31 will draw current from the power supply 10, and therefore, will be counted as a loss. In another embodiments, a switch 26 is inserted between power supply and the discharge device. After plasma 32 is formed in the discharge device, the switch 26 can be turned off to make sure no more energy is supplied to the discharge device by the power supply 10. If the plasma 32 is getting weaker the switch 26 is turned on again to supplement lost charges at the electrodes 31. The switch 26 can be operated automatically by monitoring output currents 34, 35, such as by using an ammeter or a voltage difference across a series resistor to monitor the output currents. In this embodiment, the materials for the wire electrodes 31 are chosen to control charge multiplication processes, such as a metal or semiconductor material with various conductivity to control a positive feedback process between the electric-field enhanced Paschen breakdown and charges placed in the electrode. The choice of electrode material conductivity will also depend upon the pressure of the gas medium, which controls the gain of impact ionization.

Energy Efficient Ozone Generator

Figure 4:
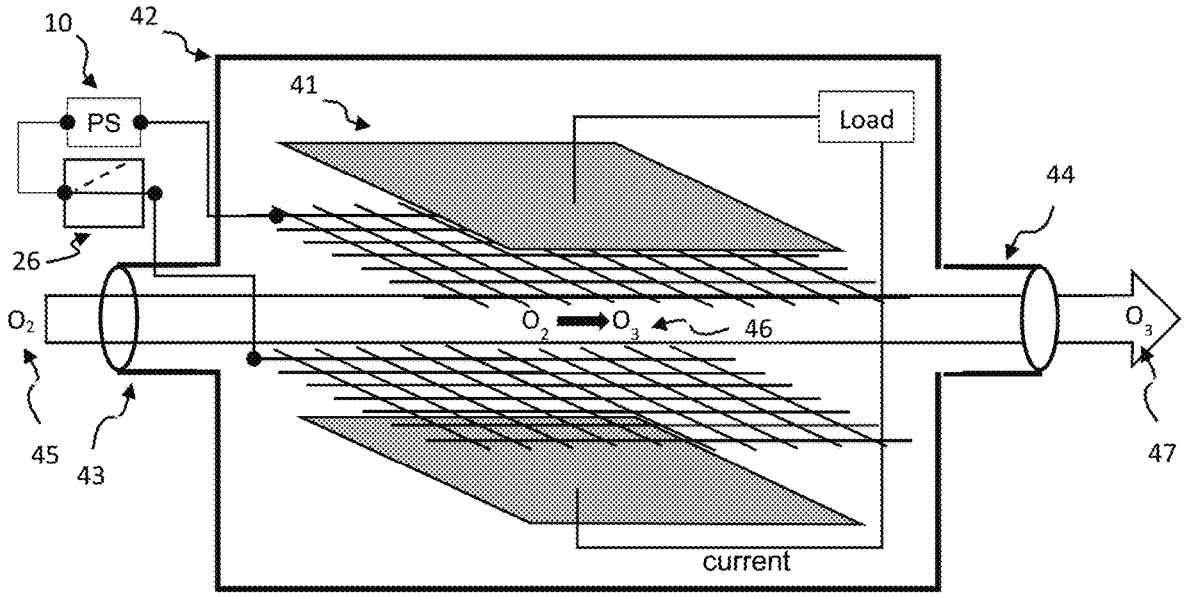
FIG. 4 illustrates an embodiment of an energy efficient ozone generator based on a power generator with charge extraction from a mesh electrode plasma system.

The embodiment described and illustrated in FIG. 4 is an energy efficient ozone generator based on a current generator with charge extraction from a mesh electrode plasma system 41 as described in FIG. 2. The current generator in FIG. 2 is modified in the embodiment of FIG. 4 with box 42, which is an enclosure with an inlet conduit 43 and outlet conduit 44. Oxygen 45 is injected into the inlet conduit and replaces existing gas medium. Plasma action produces unstable radicals, and specifically with oxygen as a gas medium, ozone 46 is generated. Generated ozone flows out 47 through the outlet conduit.

Energy Efficient Fluorescent Lamp

Figure 5:
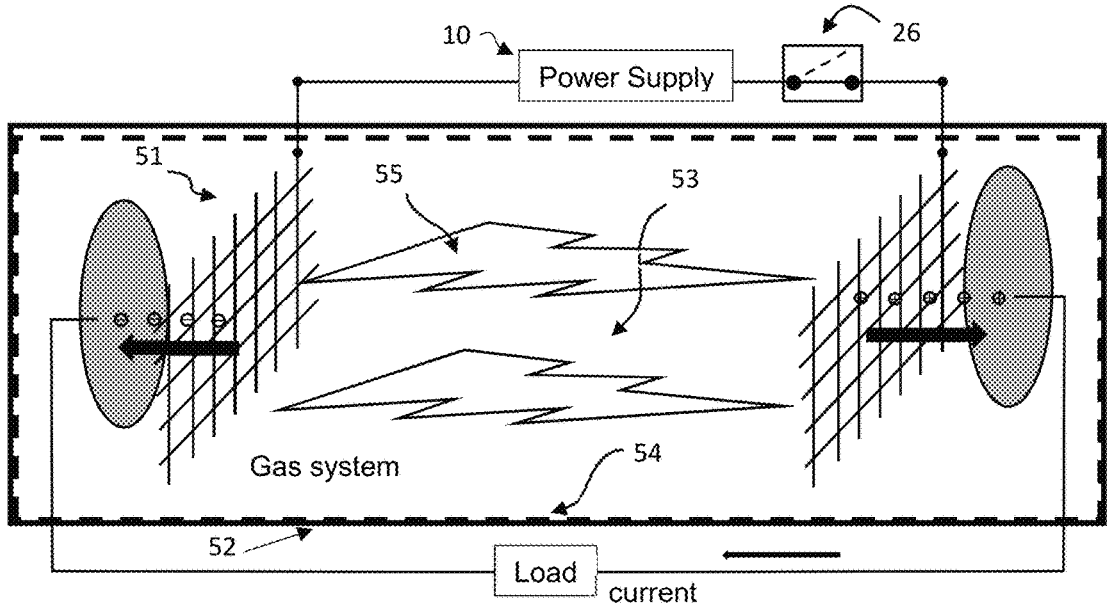
FIG. 5 illustrates an embodiment of an energy efficient fluorescent lamp based on a power generator with charge extraction from a mesh electrode plasma system.

The embodiment described and illustrated in FIG. 5 is an energy efficient fluorescent lamp based on a current generator with charge extraction from a mesh electrode plasma system 51 as described in FIG. 2. In the embodiment illustrated in FIG. 5, the current generator is enclosed inside a cavity of glass 52, where the cavity is in the shape of a tube, a box, or other hollow structure that is filled with a gas system. In embodiments, the gas system is a gas system 53 typically used in the fluorescent lamps, such as low-pressure mercury vapor with argon, xenon, neon, and krypton. An inner surface of the glass cavity is coated with fluorescent materials 54, such as phosphor, for UV-to-visible light conversion. An on-going plasma process of the current generator emits light 55 according to an emission spectra of the molecules inside.

Plasma Tube Jet With Improved Efficiency

Embodiments of a plasma tube jet described in U.S. Pat. No. 10,262,836 can be used as electric current generator by using conversion of electric potential energy to electric kinetic energy. The efficiency of the current generation, and therefore, the efficiency of ozone generation and the efficiency of fluorescence lamp can be further improved utilizing different configurations, as discussed in greater detail herein. The ideas behind greater efficiency is described briefly here. Firstly, making electric field truly parallel to the tube ensures that charges do not get stuck on the insulator-coated tube surface, and therefore increase charge extraction efficiency. Secondly, floating electrodes, (i.e., disconnecting power supply from the tube electrodes after plasma is formed), can be used to help prevent inadvertent supply of charges to the tube, as well as resetting the operation when necessary. Thirdly, having a metal or semiconductor tube without an insulator can also help continuous operation when using a DC power supply. In this case, charges that hit the tube will be compensated by the power supply to obey a voltage boundary condition, and therefore additional energy will be supplied after initial setup of electric field. However, as long as charge output from the tube is more than additional charge(s) supplied from the power supply, net energy generation occurs. The embodiments implementing the above ideas, which are described in greater detail below, include a magnetic collimator, a pin electrode at the center of the tube, a double-pole triple switch that enables floating electrodes, and a metal or semiconductor tube jet without an insulator.

Plasma Tube Jet With Magnetic Collimator

Figure 6A:
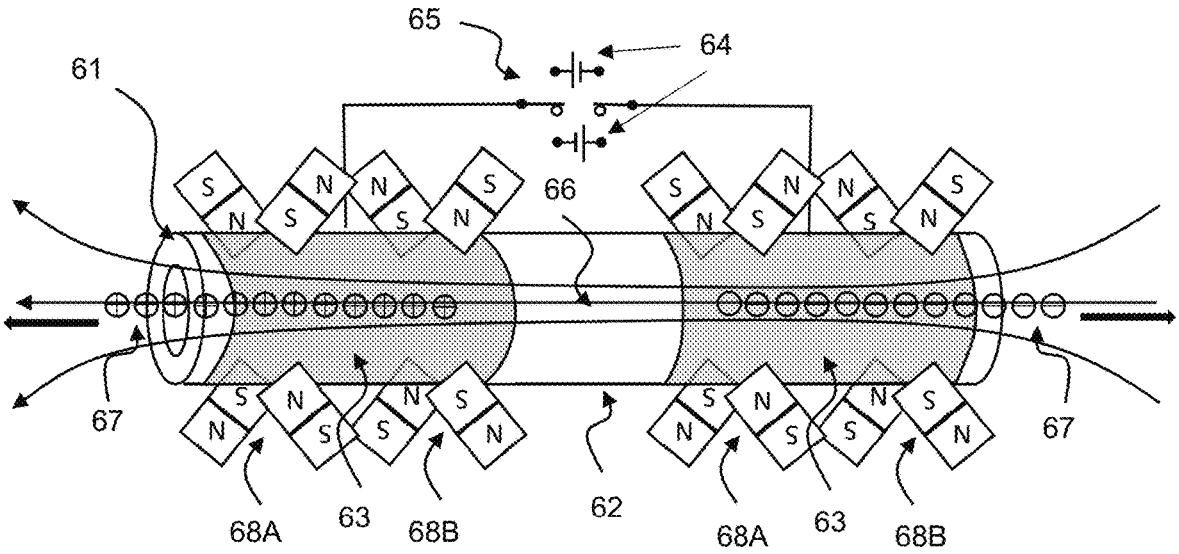
FIG. 6A illustrates a three-dimensional side view of an embodiment of a plasma tube jet with quadrupole magnets for beam collimation.
Figure 6B:
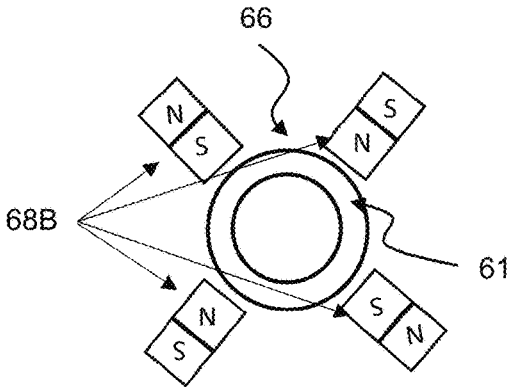
FIG. 6B illustrates a top view of an embodiment of the plasma tube jet with quadrupole magnets for beam collimation.

FIGS. 6A and 6B illustrate a modified embodiment of a plasma tube jet with charge beam collimator, with FIG. 6A illustrating a three-dimensional side view of an embodiment of the plasma tube jet with quadrupole magnets for beam collimation, and FIG. 6B illustrating a top view of the embodiment of the plasma tube jet with quadrupole magnets for beam collimation. Plasma tube jet 61 is made of insulating tube 62 such as quartz or glass with electrodes coated 63 outside, which is connected to a power supply 64. Double-pole triple-throw switch 65 is used to connected power supply to the tube electrodes. In DC, electric field 66 is formed along the axis of the tube and generated charges 67 escape from the end of the tube. However, sometimes charges adhere to the inside of the tube and negate electric field. Then, plasma action will stop. If the electric field is well collimated, charge adhesion can be reduced. In order to collimate a beam of charges, two sets of quadrupole magnets are installed outside of the tube at each side. Two quadrupoles are F-quadrupole 68A and D-quadrupole 68B. F-quadrupole 68A horizontally focusing, but vertically defocusing. D-quadrupole 68B vertically focusing, but horizontally defocusing. Combination of these two quadrupoles at a distance can collimate the beam of charges.

Plasma Tube Jet With Center Pin Electrode

Figure 7A:
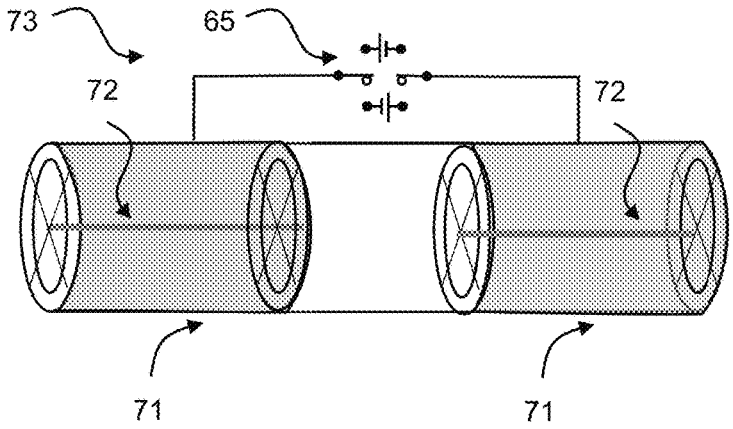
FIG. 7A illustrates a three-dimensional side view of an embodiment of a plasma tube jet with center pin electrode for uniform axial electric field.
Figure 7B:
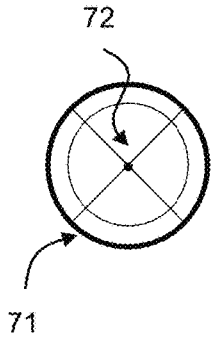
FIG. 7B illustrates a top view of an embodiment of a plasma tube jet with center pin electrode for uniform axial electric field.

FIGS. 7A and 7B illustrate embodiments of an improved plasma tube jet with a pin electrode at the center. In the linear tube geometry, electric field line ends in a normal direction at the rim electrodes 71 outside of the tube. This means that there is a radial component of the electric field, and this will induce charges to adhere to the tube. This can be avoided by having a pin electrode 72 at the center of the tube at each side that is connected to the same potential as the rim electrode at a respective side, as illustrated in FIG. 2. This will make the electric field more parallel to the tube and reduce and/or eliminate the radial component of the electric field, which will enhance charge extraction efficiency.

A Double Pole Triple Throw Switch

Figure 8:
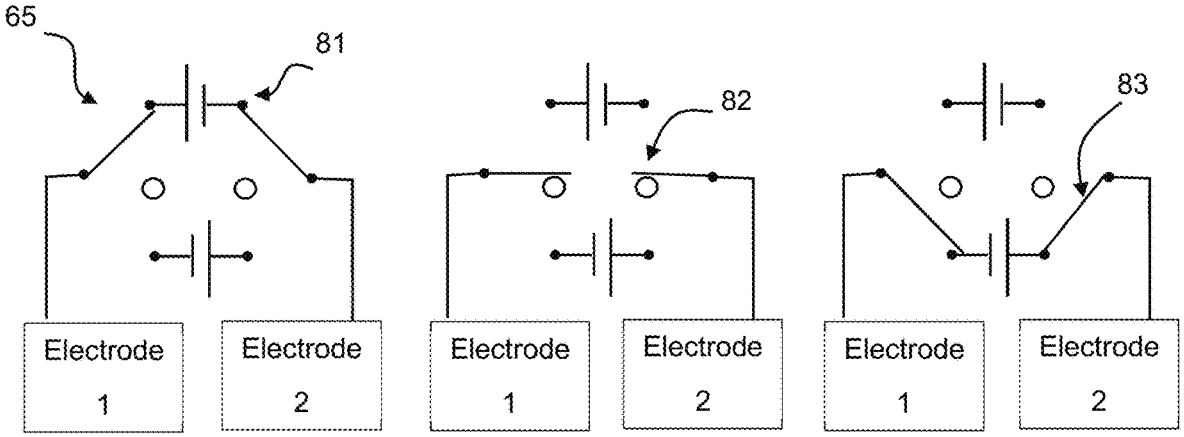
FIG. 8 illustrates an embodiment of a double-pole triple-throw switch that connects a power supply and a discharge device.

In the embodiments illustrated in FIGS. 6A-FIG. 7B, a double pole triple throw switch 65 can be used to connect to the two electrodes. FIG. 8 illustrates three throw positions in detail. One of the three throw position 81 will be for normal DC power connection. This will supply charges to electrode to establish initial electric field. The second throw position 82 is for floating. After charge is supplied to electrodes, electrodes are disconnected and floating so that charges are isolated from power supply. Floating electrodes ensure that there is no more energy supply to the discharge device from the power supply. An electric field inside the tube will still be maintained as long as there is no charge leakage. If there is a charge leakage, the switch 65 can go back to the first throw position to supply more charges. The third throw position 83 is opposite polarity of the original power connection. This is needed to remove any charges that adhered to the insulator of a discharge device, so that it can reset to original electric field when switched to the first throw position 81 with original polarity. Third throw position 83 will not be necessary if charges don't adhere to the tube. The double pole triple throw switch configuration to enable float, connect with original polarity, or connect with opposite polarity electrodes can be applied to any of the embodiments discussed herein, as well as those in U.S. Pat. No. 10,262,836.

Plasma Tube Jet—Metal or Semiconductor Tube Without Insulator

Figure 9:
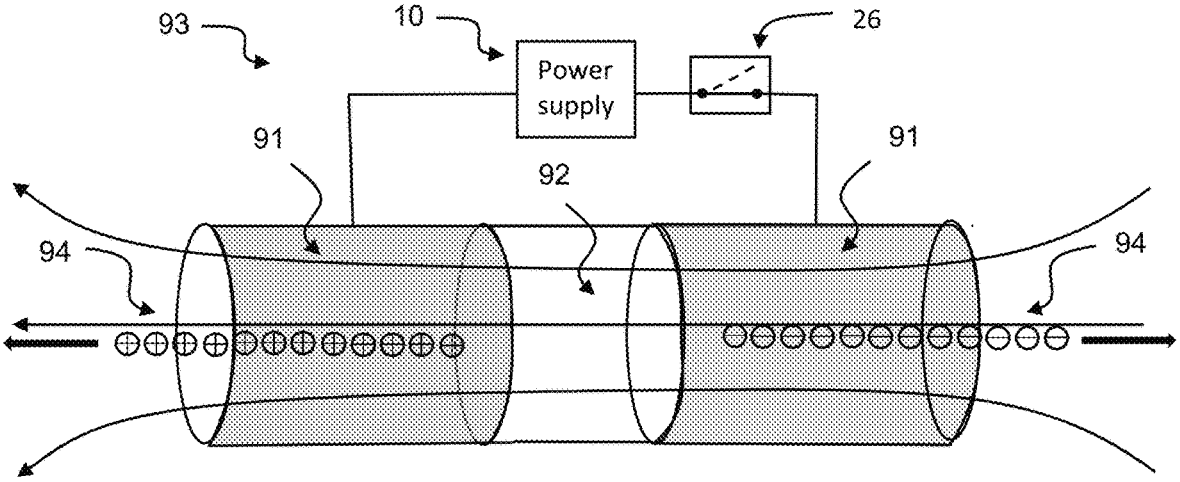
FIG. 9 illustrates an embodiment of a plasma tube jet with tubular shape electrode exposed to a gas medium without insulating tube.

A plasma tube jet, as discussed herein, can be made with metal or semiconductor tubular electrodes without any insulator on top. FIG. 9 illustrates an embodiment of such a structure where there are two electrodes 91 without an insulator on top. Two electrodes can be connected by an insulator 92, or two electrodes can be freely standing without connection. During plasma jet operation, if the electric field is not perfectly axial, and therefore charges adhere to the rim electrode, more charges need to be supplied from the power supply. This can be counted as additional energy supplied from the power supply 10. However, if the charge output from the tube is higher than charges that adhere to the tube, there is net energy output. This configuration prevents a presence of charges on top of the insulator that negates an initial electric field before plasma is formed, which can terminate plasma operation in DC. Instead, accepting opposite charges that adhere to the electrodes as energy loss and yet enable continuous operation in DC. In other embodiments, a switch 26 is inserted between power supply and the discharge device. After plasma is formed in the discharge device, the switch 26 can be turned off to make sure no more energy is supplied to the discharge device by the power supply 10. If the plasma is getting weaker, the switch 26 is turned on again to supplement lost charges at the electrodes 91. The switch 26 can be operated automatically by monitoring output currents 94. The plasma tube jet without insulating wall described here can be combined with structures to collimate electric field such as magnetic collimator and center pin electrode.

Ozone Generator

Figure 10:
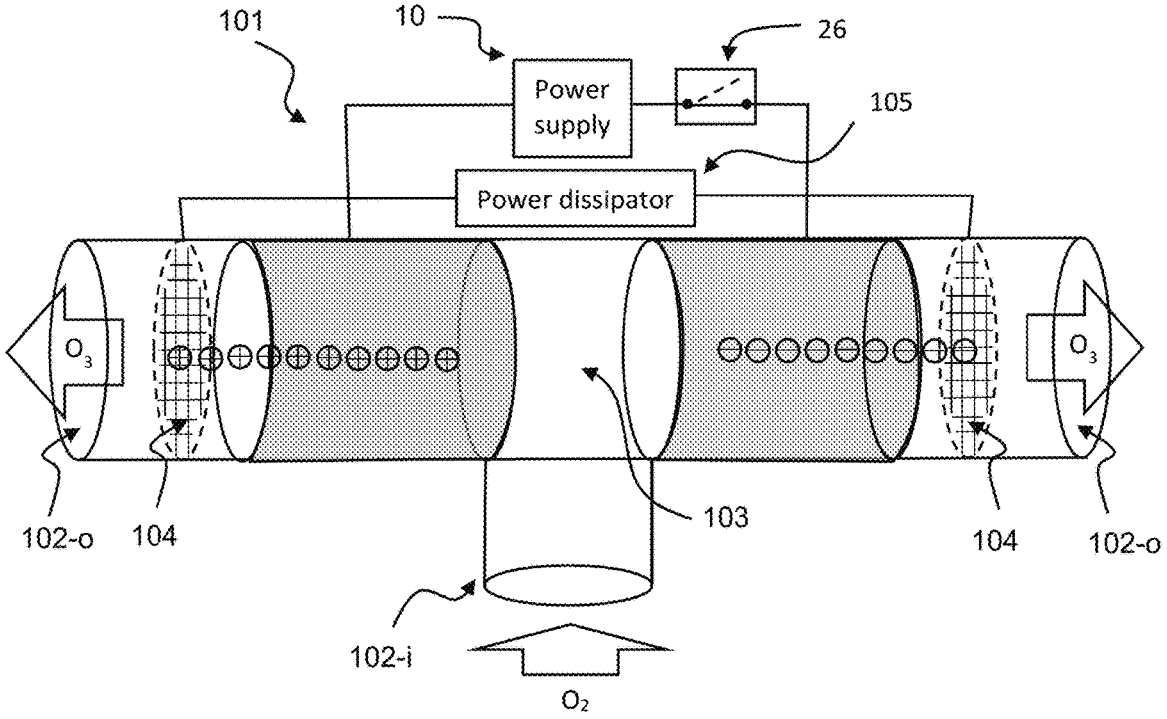
FIG. 10 illustrates an embodiment of an energy-efficient Ozone generator based on the structure of a plasma tube jet power generator.

A plasma tube jet with magnetic collimator 61, a plasma tube jet with a center pin electrode 73, and a plasma tube jet without insulator on electrodes 93 can also be used as an energy efficient ozone generator. FIG. 10 illustrates an embodiment of an ozone generator using plasma tube jet structure 101. A magnetic collimator or pin electrode can be added to the embodiment in FIG. 10. To be used as an energy efficient ozone generator, plasma tube jet 101 is coupled with a conduit for oxygen introduction 102-*i* (e.g., an inlet) and another conduit for ozone output 102-*o* (e.g., an outlet). Plasma interaction with introduced oxygen will convert oxygen into ozone in the plasma region 103 with the tube. In order for plasma action to continue, output charges 67 are captured by capture electrodes 104 and energy associated with the electric current is dissipated by a power dissipator 105. The charge capture electrodes 104 are made of meshes so that Ozone can be output through the output conduit.

Fluorescent Lamp

Figure 11:
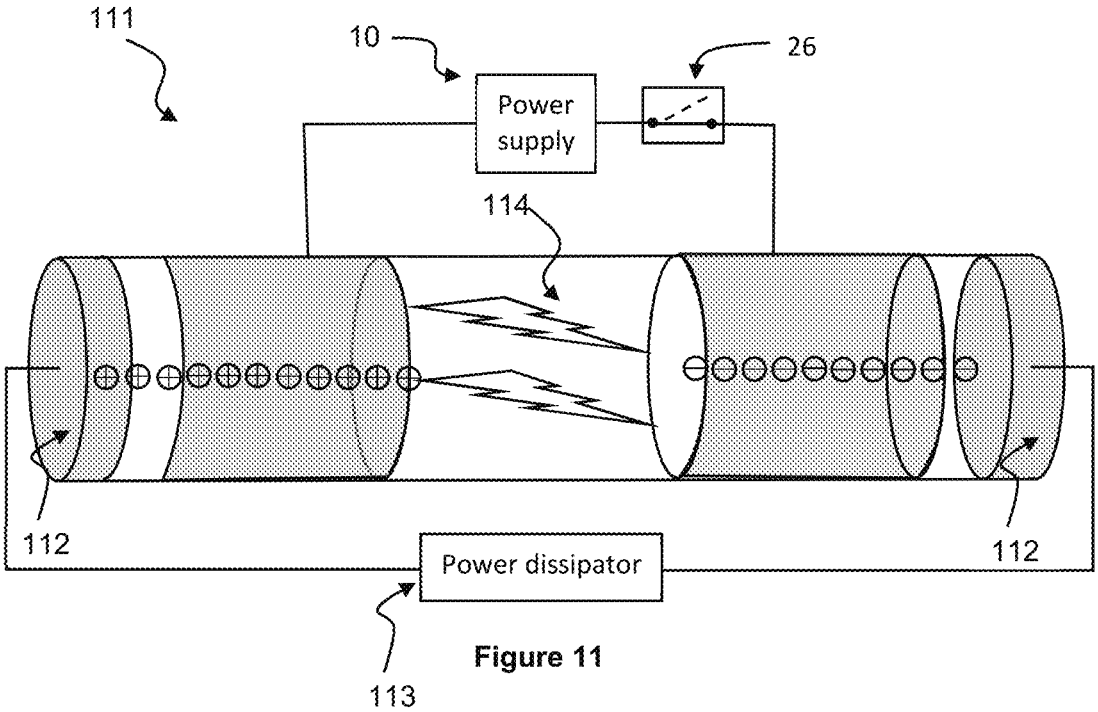
FIG. 11 illustrates an embodiment of an energy-efficient fluorescent lamp based on the structure of a plasma tube jet power generator.

A plasma tube jet with magnetic collimator 61, a plasma tube jet with a center pin electrode 73, and a plasma tube jet without insulator on electrodes 93 can also be used as an energy efficient fluorescent lamp. To be used as an energy efficient fluorescent lamp, the plasma tube jet device is enclosed in a transparent cavity and charge output is captured by capture electrodes and their energy is dissipated with a power dissipator such as electrical resistor. FIG. 11 illustrates an embodiment of fluorescent lamp using plasma tube jet structure 111. A magnetic collimator or pin electrode can be added to the embodiment in FIG. 11. Since the tube itself can be made with transparent material such as glass, it is also possible to skip extra use of a transparent enclosure and just close the end of the tube with end caps 112. In FIG. 11, end caps 112 are also used as charge capture electrodes and whose energy is dissipated by a power dissipator 113, such as an electrical resistor. During the plasma process with the plasma tube jet, light 114 is emitted naturally and can be used as a fluorescent lamp. A typical gas medium used for fluorescent lamps, including mercury vapor mixed with one or more of argon, xenon, neon, krypton, etc., can be used. If the emitted light is UV, fluorescent material for UV-to-visible conversion can be coated on the transparent cavity. The concept of double pole triple throw switches and naked tube also applies to the embodiments of ozone generators and fluorescent lamps, as discussed herein, operating with enhanced efficiency.

Joint of U-Shaped Plasma Tube Jet and Y-Junction for Wind Passage

Figure 12:
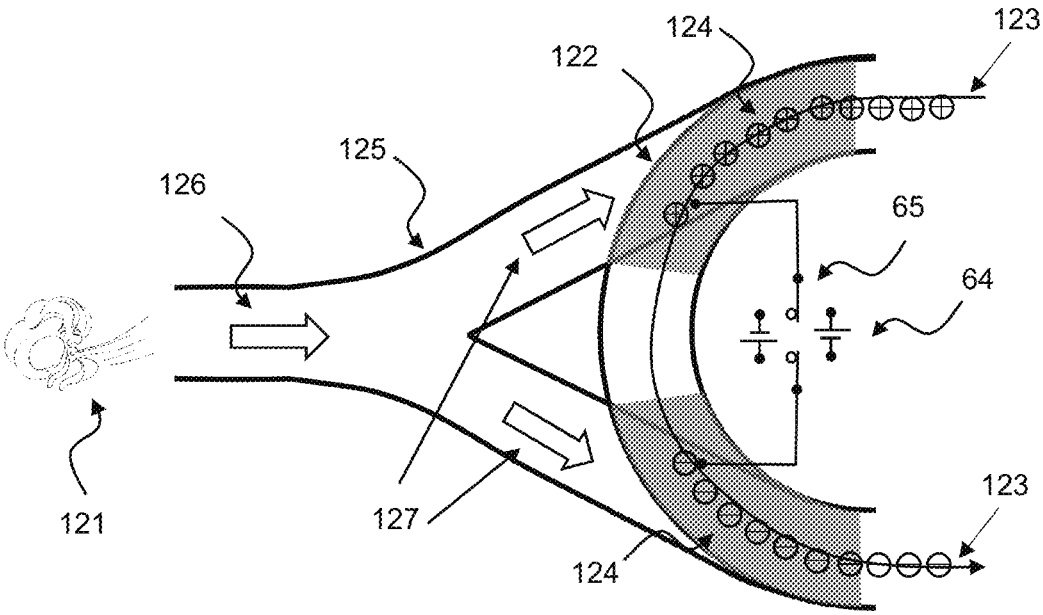
FIG. 12 illustrates an embodiment of a joint of a U-shaped plasma tube jet and a Y-junction for wind passage.

FIG. 12 illustrates a modified plasma tube jet adapted for blowing charges with wind. Linear tubes jet both positive charges and negative charges in opposite directions, but wind 121 usually blows in one direction. Therefore, it is difficult to use wind for charge extraction in a linear tube. In order to efficiently use wind for extraction of both charges, and with reference to FIG. 12, a tube is bent into a U-shape 122. U-shaped tube will bend electric field 123 into U-shape as well. Since charge passage 124 will follow electric field, charges 124 will still follow the center of the U-shaped tube 122. If a Y-shaped tube 125 is made to merge with the U-shaped tube 122, wind that enters into the one end 126 of the Y-shaped tube 125, split into two 127, and merges into the U-shaped tube where charges are present. In this embodiment, wind will more efficiently blow charges 124 away from the U-shaped tube. As mentioned above, quadrupole magnets and/or center pin electrodes can be added to the U-shaped tube so that charges are collimated and do not adhere to the inside wall of the tube. Then, efficiency will be further increased.

It is to be understood that the above description is intended to be illustrative, and not restrictive. Many other embodiments will be apparent to those of skill in the art upon reading and understanding the above description. It will be appreciated by those of ordinary skill in the art that any of the embodiments discussed above may be used for various purposes according to the particular implementations, design considerations, goals, etc. The scope should, therefore, be determined with reference to the appended claims, along with the full scope of equivalents to which such claims are entitled.

The foregoing description, for purpose of explanation, has been described with reference to specific embodiments. However, the illustrative discussions above are not intended to be exhaustive or to limit the described embodiments to the precise forms disclosed. Many modifications and variations are possible in view of the above teachings. The embodiments were chosen and described in order to best explain the principles and practical applications of the various embodiments, to thereby enable others skilled in the art to best utilize the various embodiments with various modifications as may be suited to the particular use contemplated.

What is claimed is:

1. A system for energy conversion of electrical potential energy to electrical kinetic energy, the system comprising:

a discharge device;

a power supply, coupled with the discharge device, that supplies energy to the discharge device to form an initial electric field, wherein the discharge device comprises at least two electrodes being two mesh electrodes or two wire-array electrodes, wherein a space between the at least two electrodes is filled with a gas medium, and wherein the initial electric field is formed by the power supply in a normal direction relative to planes formed by the mesh or wire-array electrodes, and wherein electric charges are generated when cosmic rays pass through the discharge device, the generated electric charges having an electrical potential energy, wherein the electrical potential energy of the generated electric charges is converted into electrical kinetic energy by acceleration within the electric field, and wherein accelerated charges are multiplied by impact ionization of gas molecules in the gas medium; and one or more charge capturing electrodes made of a metal material to capture electric charges expelled through the mesh or wire-array of the at least two electrodes.

2. The system of claim 1, wherein generated electric charges are expelled from the discharge device through the mesh or wire array of the at least two electrodes to an exterior of one or more of the at least two electrodes, wherein a number of expelled electric charges is more than a number of electric charges intercepted by the electrodes, wherein a total number of expelled electric charges is more than a total number of charges supplied to the at least two electrodes by the power supply, and wherein a total energy output associated with the expelled charges is higher than a total energy supplied by the power supply.

3. The system of claim 1, wherein a total energy of multiplied charges is greater than an initial potential energy of charges created when cosmic rays pass through the discharge device; wherein the total energy of multiplied charges is greater than the initial potential energy because of electric field enhancement within the discharge device by a positive feedback processes between electric field and charges at the electrodes that are supplied from the power supply, in order to satisfy voltage boundary conditions, and wherein energy output from the discharge device generated by the positive feedback processes is more than cosmic ray energy harvesting.

4. The system of claim 1, where the mesh or wire-array of the at least two electrodes are made of metal.

5. The system of claim 1, wherein the mesh or wire-array of the at least two electrodes are made of semiconductor or a semiconducting coating on the surface of metal mesh or wire.

6. The system of claim 1, where in the mesh or wire-array of the at least two electrodes are made of a conductive oxide or a combination of oxides such as aluminum oxide, titanium oxide, chromium oxide, tin oxide, zinc oxide, or a coating of such materials on the surface of metal mesh or wire.

7. The system of claim 1, further comprising:

a structure forming a cavity that encloses the discharge device and a gas medium within the cavity.

8. The system of claim 7, where a gas pressure of the gas medium within the cavity is less than one atmosphere.

9. The system of claim 7, wherein the gas medium is a gas comprising one or helium, argon, nitrogen, oxygen, or a combination thereof.

10. The system of claim 1, further comprising:

an electrical switch between the power supply and the discharge device, wherein the switch is open after a start of operation of the discharge device to prevent energy transfer from the power supply to the discharge device, wherein the switch closes when an output current from the discharge device decreases, and wherein a net output energy from the discharge device is greater than the energy supplied from the power supply.

11. The system of claim 1, wherein the discharge device is a power source that supplies a flow of electrical charges or electrical current to an electrical device when this discharge device is coupled with the electrical device.

12. The system of claim 1, further comprising:

a transparent enclosure with the gas medium and the discharge device contained within the transparent enclosure, wherein photons are emitted during impact ionization.

13. The system of claim 12, wherein the gas medium comprises a low-pressure mercury vapor mixed with one or more of argon, xenon, neon, and krypton, and wherein an inner surface of the transparent enclosure is coated with a fluorescent material for UV-to-visible light conversion.

14. The system of claim 1, further comprising:

an enclosure having the discharge device contained therein, the enclosure comprising two conduits attached to the enclosure that are open to an exterior of the discharge device, a first conduit of the discharge device through which oxygen gas ($O_2$) flows into the discharge device, wherein the impact ionization converts the oxygen gas into ozone ($O_3$); and a second conduit of the discharge device through which the ozone is emitted from the discharge device.

15. A method for energy conversion of electrical potential energy to electrical kinetic energy, the method comprising:

supplying energy from a power supply to a discharge device forming an initial electric field, wherein the discharge device comprises at least two electrodes being two mesh electrodes or two wire-array electrodes, wherein a space between the at least two electrodes is filled with a gas medium, and wherein the initial electric field is formed by the power supply in a normal direction relative to planes formed by the mesh or wire-array electrodes;

generating electric charges when cosmic rays pass through the discharge device, the generated electric charges having an electrical potential energy, wherein the electrical potential energy of the generated electric charges is converted into electrical kinetic energy by acceleration within the electric field, and wherein accelerated charges are multiplied by impact ionization of gas molecules in the gas medium; and capturing, by one or more charge capturing electrodes that are made of a metal material, charges expelled through the mesh or wire-array of the at least two electrodes.

16. The method of claim 15, wherein the discharge device is a power source that supplies a flow of electrical charges or electrical current to an electrical device when this discharge device is coupled with the electrical device.

17. The method of claim 15, further comprising:

expelling the generated electric charges from the discharge device through the mesh or wire array of the at least two electrodes to an exterior of one or more of the at least two electrodes, wherein a number of expelled electric charges is more than a number of electric charges intercepted by the electrodes, wherein a total number of expelled electric charges is more than a total number of charges supplied to the at least two electrodes by the power supply, and wherein a total energy output associated with the expelled charges is higher than a total energy supplied by the power supply.

* * * * *